US006830220B2

(12) United States Patent
Runyan

(10) Patent No.: US 6,830,220 B2
(45) Date of Patent: Dec. 14, 2004

(54) KITE CONTROL BAR WITH NINETY-DEGREE HANDLES AND FAIL-SAFE RELEASE SYSTEM

(76) Inventor: Max Robert Runyan, 4922 Charlene Cir., Huntington Beach, CA (US) 92649

( * ) Notice: Subject to any disclaimer, the term of this patent is extended or adjusted under 35 U.S.C. 154(b) by 0 days.

(21) Appl. No.: 10/367,319

(22) Filed: Feb. 19, 2003

(65) Prior Publication Data

US 2004/0159747 A1 Aug. 19, 2004

(51) Int. Cl.[7] ..... B64D 1/22
(52) U.S. Cl. ..... 244/155 A; 244/152; 244/142
(58) Field of Search ..... 244/900, 153 R, 244/155 A, 155 R, 142, 152, 151 R

(56) References Cited

U.S. PATENT DOCUMENTS 4,981,271 A 1/1991 Carter
5,024,401 A 6/1991 Nakashima
5,213,289 A 5/1993 Barresi
6,260,803 B1 * 7/2001 Hunts ..... 244/155 R
6,273,369 B1 8/2001 Nishmura et al.
6,513,759 B2 2/2003 Starbuck
6,514,115 B2 * 2/2003 Harich ..... 446/34
6,581,879 B2 * 6/2003 Bellacera ..... 244/155 A

* cited by examiner

*Primary Examiner*—Peter M. Poon
*Assistant Examiner*—Timothy D. Collins
(74) *Attorney, Agent, or Firm*—Howard A. Kenyon

(57) ABSTRACT

A Kite Control Bar with Ninety-Degree Handles and Fail-Safe Release System is disclosed. The kite control bar utilizes a metal bar with removable metal handles that are attached to the kit control bar at a ninety-degree angle. The kite control bar also incorporates a release system that is a pull pin located on the kite control bar. If required to de-power the kite, the release system will release the kite control lines which will deflate the kite and negate the kites strong pull force. The metal handle attached to the kite control bar at ninety-degrees in conjunction with the release system will significantly improve the control of the kite when performing the sport of kite surfing or kite boarding.

12 Claims, 10 Drawing Sheets

KITE CONTROL BAR WITH NINETY-DEGREE HANDLES AND FAIL-SAFE RELEASE SYSTEM

RELATED U.S. APPLICATIONS

Provisional Application No. 60/350,929, dated Jan. 25, 2002 for "Kite Control Bar with Ninety-Degree Handles".

BACKGROUND OF THE INVENTION

1. Field of the Invention

This invention relates to kite control bars in general and more particularly to a kite control bar with handles that are attached ninety degrees to the kite control bar longitudinal axis and a pull pin release system located on the kite control bar.

2. Description of the Prior Art

Recently there has developed a new sport that is a follow-on from what is known as windsurfing. Wind propulsion has also propelled iceboats and land craft. The new design of kites and related equipment has led to a sport called kite surfing or kite boarding that involves a person manipulating a large kite to power a surfboard. The kites used in this sport generates large forces which can lift a person attached to a surfboard off the water, whereby the person can do fancy stunts, completely in the air, and land safely back on the water in a surfing position. The person doing kitesurfing and stunt maneuvers in the air needs controls to maneuver the kite for convenience and safety.

The method of maneuvering a kite while kitesurfing is by control lines attached to the kite on one end and the control lines are attached to what is known as a kite control bar on the other end. There are two-line inflatable kites and four-line inflatable kites. The kite control bar describes by the present invention is for a four-line kite although the kite control bar could easily be adapted for a two-line configuration.

The present configuration also incorporates a fail-safe system that, when activated, will release the control lines and de-power a kite.

In the past kite boarders or kite surfers have been severely injured or killed when they have been unable to release themselves from their kite control bar during unforeseen dangerous situations. For example, these situations may occur when launching from land in gusty, unpredictable wind conditions while being hooked into their static or dynamic harness line. If kite control is lost during this period, the user may be dragged across objects or pulled under water for prolonged periods of time because they cannot release themselves from the pull of the powerful kite resulting in severe bodily injury or death. Thus, it is imperative that the user have a fail-safe release system that will de-power a kite for a kite boarder or kite surfer.

There are a number of systems available while kite surfing or kite boarding. These include quick release systems that are necessary when de-powering a kite.

U.S. Pat. No. 6,273,369 B1 by Nishimura describes a kite control and quick release system. This patent attaches to the control lines to a specially designed end cap fastened at the end of the kite control bar. If the kite and/or user forces are not directed through the center of the longitudinal axis of the control bar, the bar will proceed to load up with torque and twist. The combination of these forces will reduce kite control, steering comfort and will require energy and effort to counter any out-of-balance forces. The Nishimura's kite release mechanism requires the user to let go of the kite control bar to diminish the pulling power of the kite but does not address the dilemma if the user is unable to release themselves from the kite control bar while being hooked into the harness line.

U.S. Pat. No. 4,981,271 to Carter is directed to a stunt kite string winder. The kite surfing requires long lines between the control bar and the kite. Keeping the lines from becoming entangled when storing the kite has been a problem to kite surfing. Cater provides a device which is capable of rapidly and simultaneously winding a pair of stunt kite lines on to a pair of line handles.

U.S. Pat. No. 5,213,289 to Barresi describes a framed airfoil kite having two control handles with control lines attached to the framed airfoil kite.

U.S. Pat. No. 5,024,401 to Nakashima discloses an apparatus for controlling quad-line stunt kites of a type having a pair of handles with lines connected to each end of each handle.

Another release mechanism demonstrated in the kite boarding industry offers a quick release mechanism along the length of the harness line. The mechanism is a folded over pin design and is located along the length of the harness line. When actuated the folded over pin is allowed to straighten out and release the closed loop, releasing the user from being "hooked in", allowing the kite control bar to fly away from the user. The release mechanism is located along the length of the harness line in the form of a flat ribbon or rope tether. It is free to flap in the wind and may be difficult or impossible to locate quickly during an out of control situation. When successfully employed this release mechanism allows the user to become detached from the kite, but allows the kite and kite control bar to fly out of control. The kite, the kite control bar and or kite lines may be significantly damaged during flight or an innocent bystander may be injured before the kite comes to a final rest when this method of kite release is utilized.

All of the above patents and descriptions do not address the advantages of having a kite control handle that is ninety degrees to the longitudinal axis of the control bar nor do they address a fail-safe release system which, when activated, will release the control lines and de-power for a kite boarder or kite surfer.

SUMMARY OF THE INVENTION

It is object of the present invention to provide a tubular metal kite control bar that is sealed on each end.

It is another object of the present invention to include metal cross tubes welded in the tubular bar.

It is still another object of the present invention to provide removable metal control handles inserted in the cross tubes whereby the metal control handles are ninety degrees to the longitudinal axis of the control bar.

It is yet another object of the present invention to pass the control lines through the hollow tube of the ninety-degree handle where the control lines are secured at the end of the hollow tube of the ninety degree handle.

It is another object of the present invention to provide control handles that will significantly improve the controlling of the kite when performing the sport of kite surfing.

It is yet another object of the present invention whereby the ninety-degree handles provide a device to wind and store the control lines.

It is still another object of the present invention to provide a fail-safe release system that will release the control lines from the control bar and de-power the kite for a kite boarder or kite surfer.

Briefly, in accordance with the present invention, there is provided a metal kite control bar that has removable hollow metal handles fitted ninety degrees to the longitudinal axis of the metal kite control bar. The kite control lines pass through the removable hollow metal tube of the control handle and the control line is secured to the kite control bar.

Also briefly, in accordance with the present invention, there is also provided a release system that is fitted with a special pull pin release mechanism attached to the kite control line loop on the kite control bar. The pull pin release mechanism line is threaded through a loop in the kite control lead lines. The pin release mechanism line that is preferably made of multi-strand wire is trapped inside of the kite control bar guide tubes which are attached to the kite control bar. When a release handle, located in the middle of the kite control bar, is pulled or actuated, the strong pulling power of the kite will be released suddenly without having to let go of the kite control bar. This kite release mechanism located in the center of the kite control bar, will greatly improve the chance of the user quickly releasing the power of the kite in out of control, hooked in situations and may avoid the chance of or injury or death. The release mechanism handle can be located quickly and activated with either or both hands. Because of its central position on the kite control bar, the release handle can be quickly located without the need for the user to visually see it during out of control spinning maneuvers or while being dragged under water.

Other objects and advantages will become apparent from the following description and appended claims taken in conjunction with accompanying drawings.

These and other objects, features and advantages of the present invention will become more readily apparent upon detailed consideration of the following description of the preferred embodiments with reference to the accompanying drawings.

DESCRIPTION OF THE PREFERRED EMBODIMENT

Figure 1:
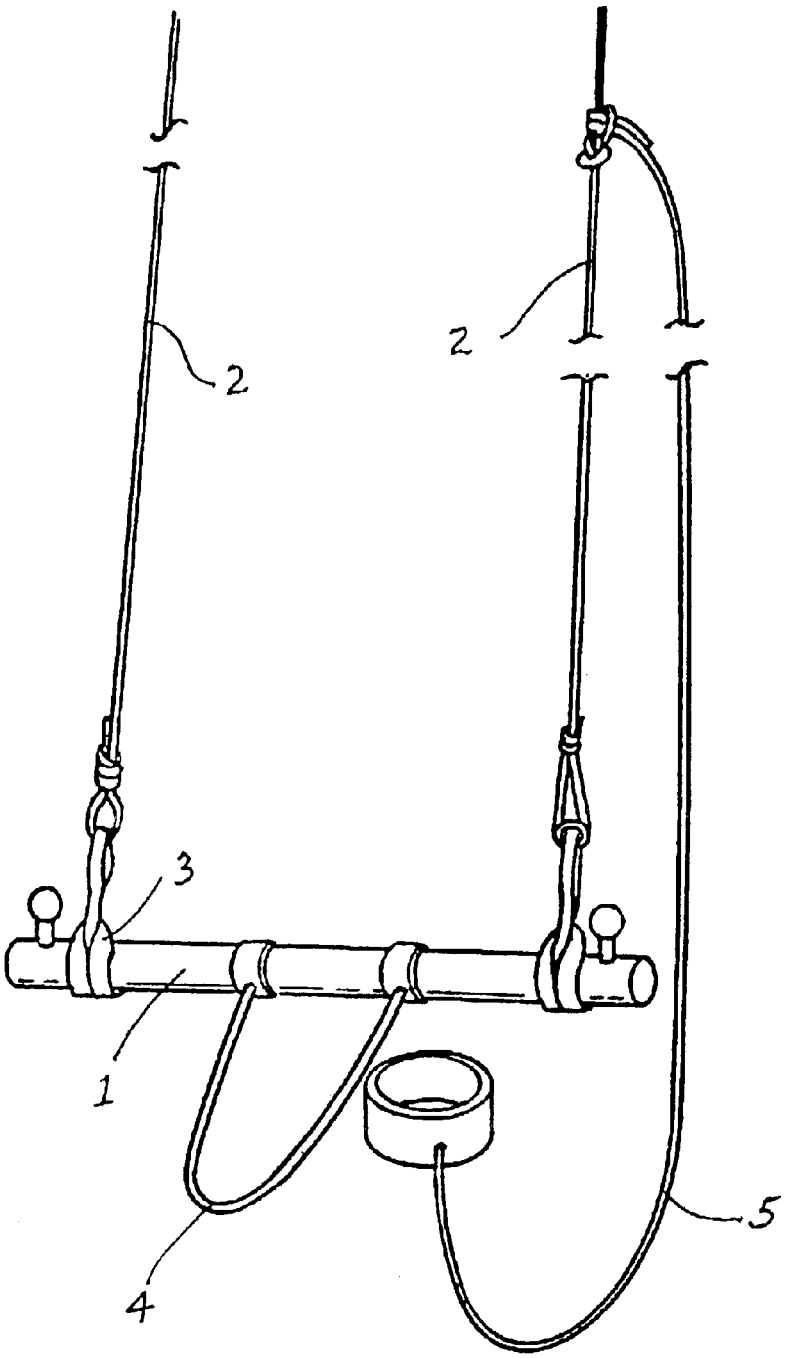
Prior Art Fig 1
FIG. 1 is prior art that is a two-line kite control bar, with slip on kite line and harness line/loop attachment.

Turning now to FIG. 1 there is seen a prior art view of a kite control bar designated as 1, the steering control lines 2 and the attachment 3 of the control lines 2. The harness line and loop is shown as 4 and the kite safety release line and wrist leash is given as 5.

Figure 2:
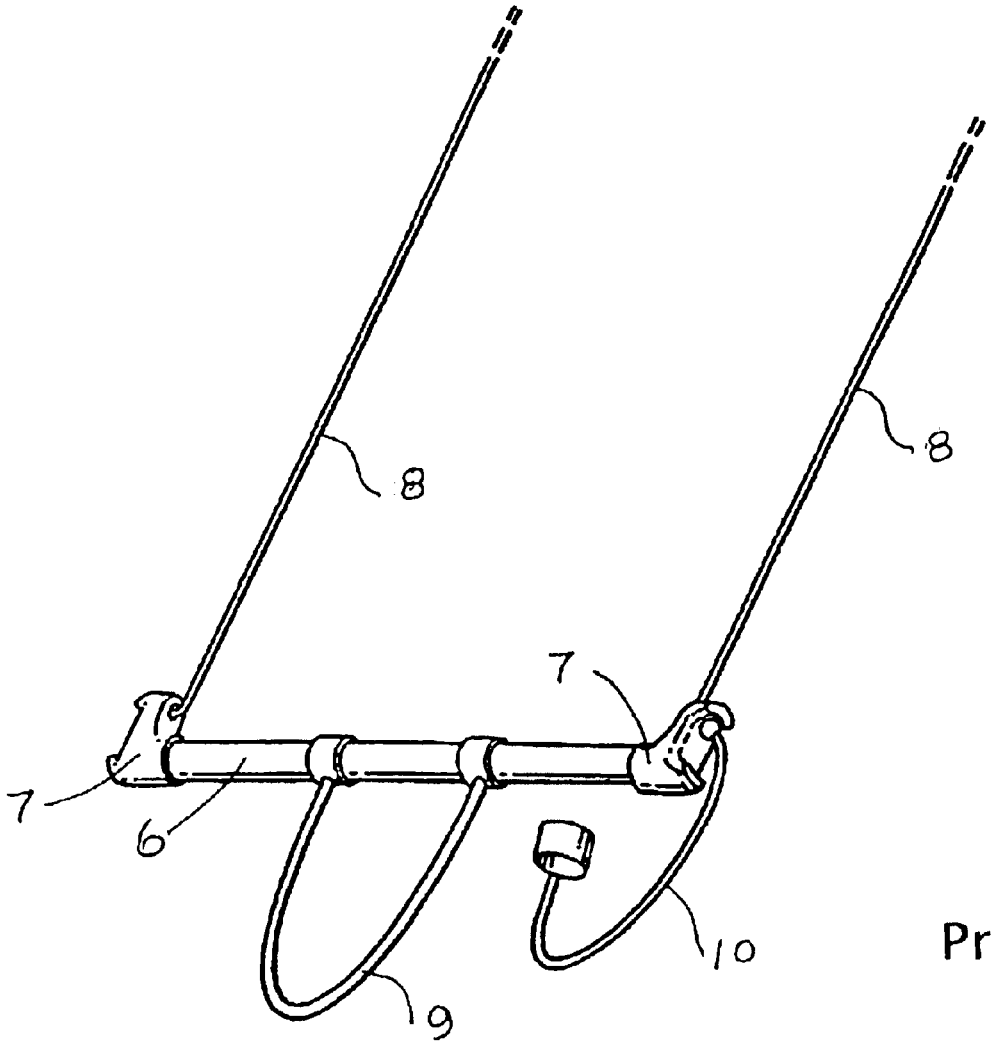
Prior Art Fig 2
FIG. 2 is prior art that is a two-line kite control bar end fittings where kite control lines are attached.

FIG. 2 provides another prior art configuration where the control bar is given as 6, the control bar end caps 7, the steering and control lines as 8 and the static harness line and loop is 9.

It should be noted that the harness line and loop which is common to all kite surfing bar assemblies is mated with a hook (not shown) located on the kite surfer's belt (not shown) to provide relief when holding the kite control bar is too much of a strain on the hands. In this prior art view of FIG. 2, the kite safety release line and wrist leash is given as 10. In this configuration the control lines are attached to an elongated end cap and is designated as 7. This type of end cap will place a rotational force on the end cap, which may cause the end cap to be pried off the control bar. This could result in catastrophic results.

Figure 3:
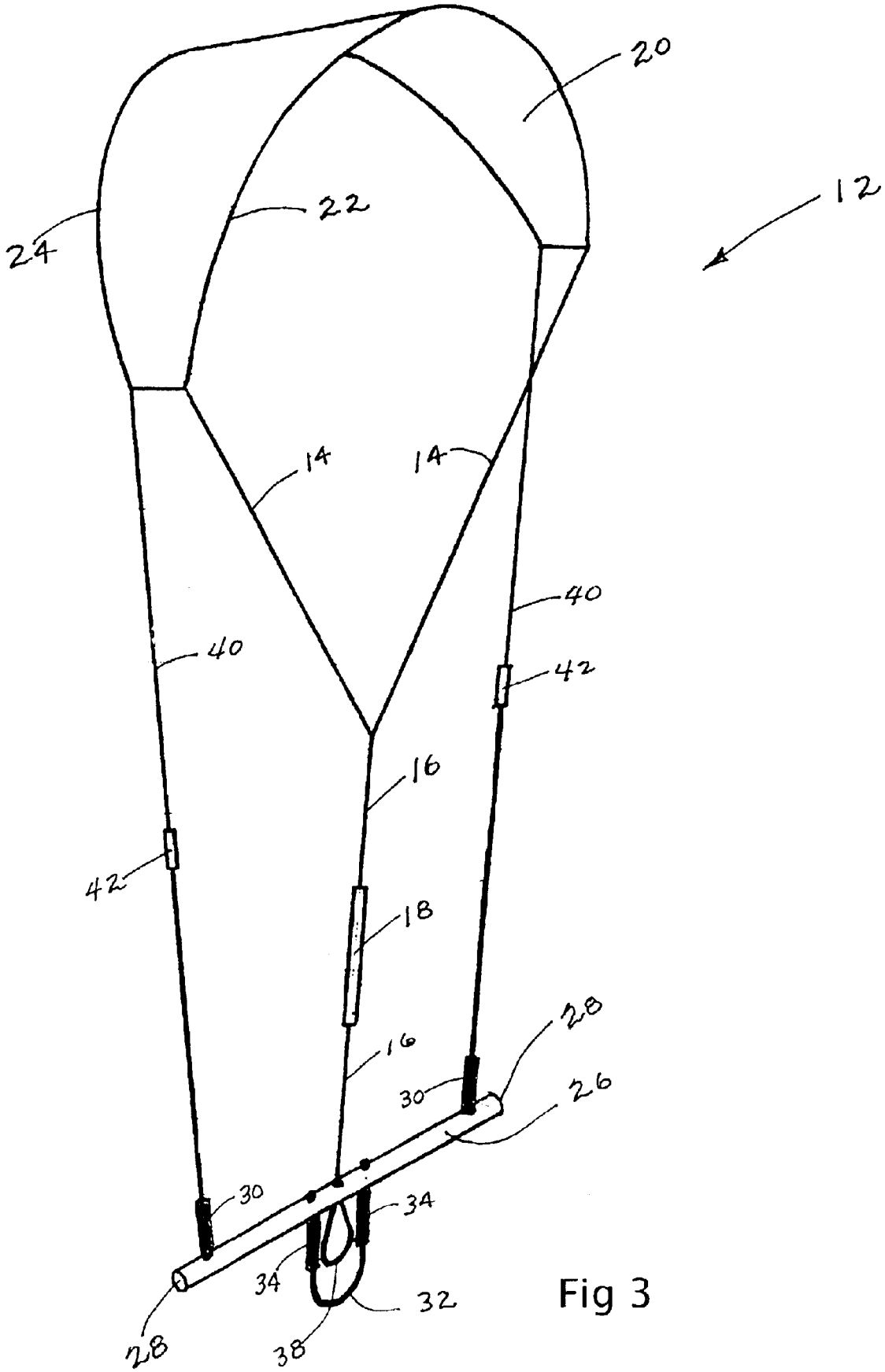
FIG. 3 is a perspective view of a four-line control bar and kite with through the bar control lines, a brake line, a harness line and loop and a dynamic brake line and loop attachment.

Turning now to FIG. 3, there is shown a perspective view of a kite and control system 12, which shows a four-line kite control system. This figure discloses the preferred embodiment of the present kite control system. The two brake lines 14 have been merged into one line 16. Item 18 is a static brake line adjustor and connector which can be used to adjust the kite angle of attack. In this view there is seen the kite 20 having a leading edge 22 and a trailing edge 24. The kite control bar 26 is made out of metal and has welded ends 28 to prevent moisture from entering the kite control bar 26. In the preferred embodiment the kite control bar 26 will be made from either titanium or stainless steel. Also seen in this view are the removable control line ninety-degree handles 30. These control lines handles 30 will be detailed more fully further on in this application. Also seen in this view is a static harness line loop 32, which also includes lower ninety-degree handles 34. The dynamic brake line loop 38 (also known as a chicken loop) will be detailed more fully further on in this Application. FIG. 3 also shows the control lines 40 that are connected to the kite trailing edge 24. The control lines 40 have connectors 42 to be able to disconnect the kite from the kite control bar 26.

Figure 4:
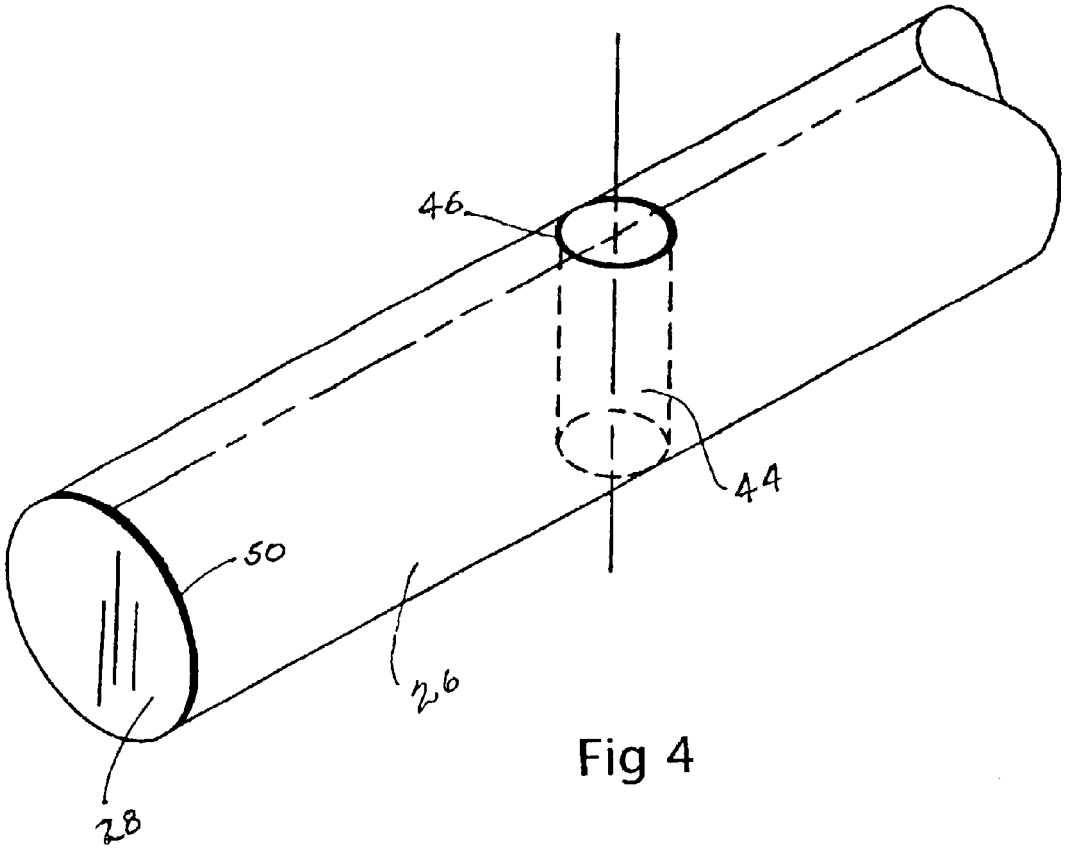
FIG. 4 shows a metal cross tube welded in the metal kite control bar. This figure also shows a metal end cap welded on the metal control bar.

FIG. 4 shows a portion of the metal kite control bar 26 where a short metal cross tube 44 is placed in the metal kite control bar 26. The short metal cross tube 44 is welded on to the metal kite control bar 26 by weld 46. The short metal cross tube is also welded on the other end (not shown) to the metal kite control bar 26. The preferred embodiment has five of these cross tubes 44 (not shown) welded thereon to the metal kite control bar 26. Also seen in this view is metal end cap 28 welded to the metal kite control bar 26 by weld 50. Both ends of the kite control bar 26 have metal end caps welded thereon.

Figure 5:
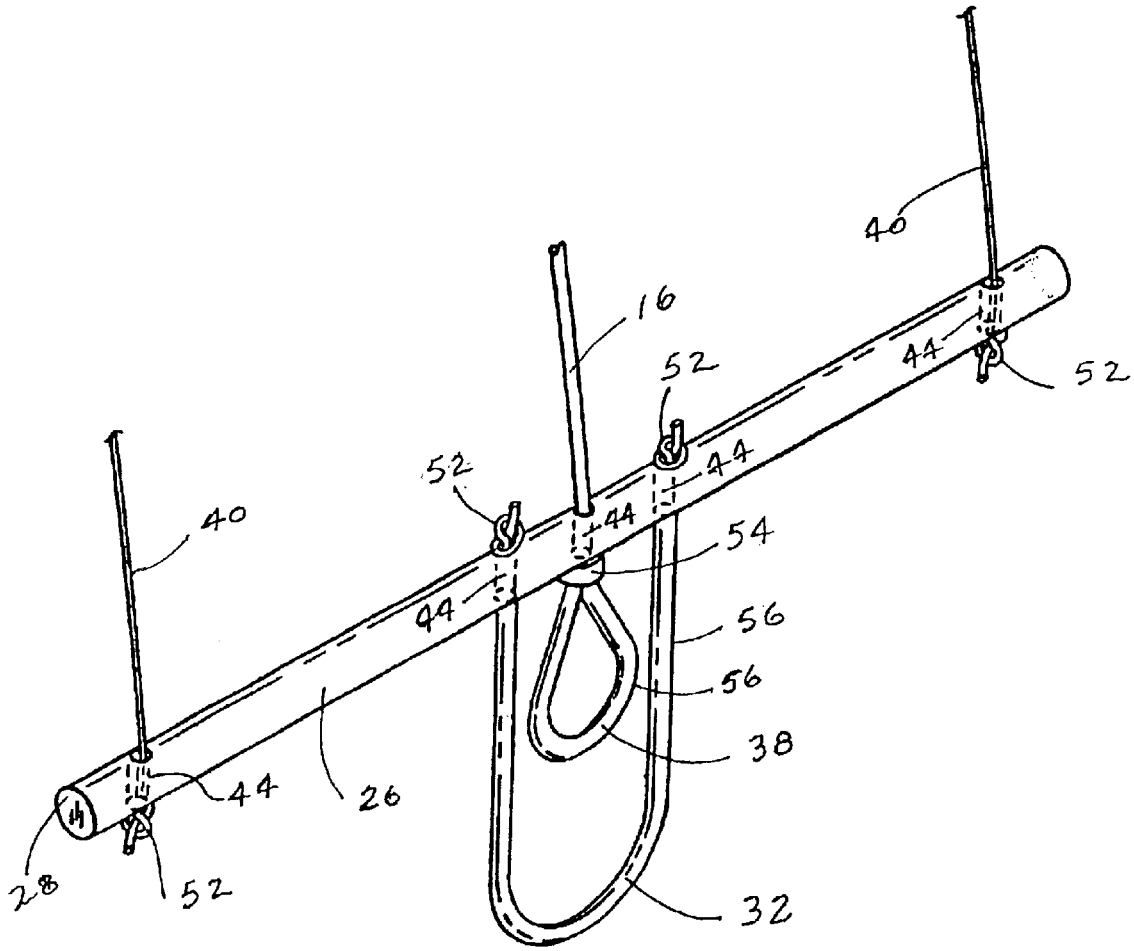
FIG. 5 shows a control bar for the present invention with five welded cross control tubes, control bar handle, control lines, dynamic brake line and loop and static harness line and loop.

FIG. 5 shows the kite control system without the ninety-degree handles installed. This view shows control lines 40, kite control bar 26, end cap 28, brake line 16, dynamic brake line and loop 38 and static harness line and loop 32. This figure also shows the manner, which the lines are fastened to the kite control bar 26. The lines that pass through the kite control bar 26 also pass through a metal washer (not shown) and then have a knot tied on the line designed as 52. It should be noted that the static harness line and loop 32 and the dynamic brake line and loop 38 are encased in plastic tubing 56. The brake line 16 is attached to brake line and loop 38 and has a stop 54 that prevents brake line and loop 38 from passing through the short metal cross tube 44. This figure also shows all five metal cross tubes 44 as dashed lines.

Figure 6:
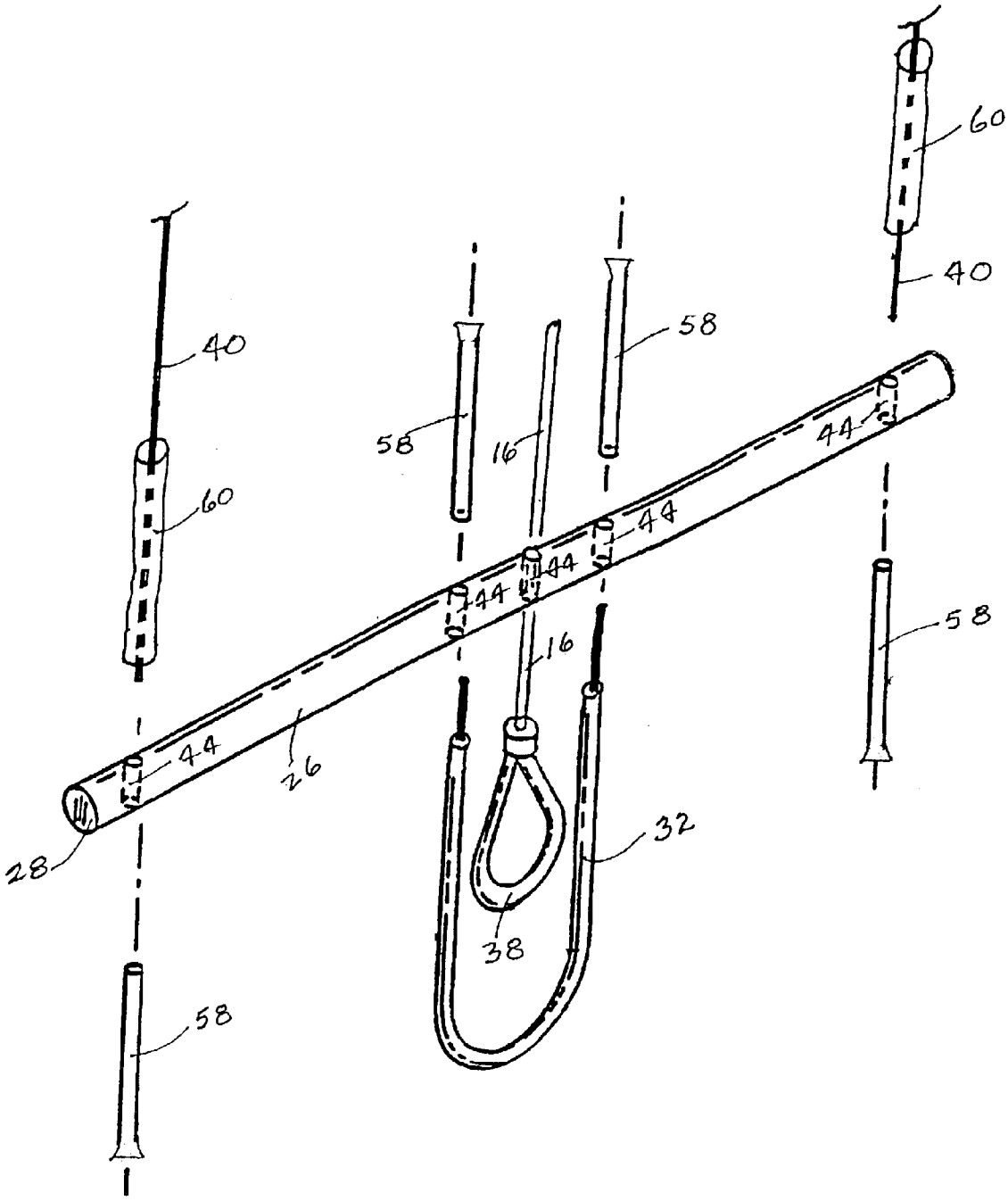
FIG. 6 shows five cross tubes welded in place with the kite bar assembly in an exploded view.

FIG. 6 shows an exploded view of the preferred embodiment. In this view there is seen short cross tubes 44, the control lines 40, the ninety-degree handle metal inserts 58, rubber covering 60 for the metal inserts 58, the kite control bar 26, the brake line 16, static harness line and loop 32 and the dynamic brake line and loop 38. It should be noted that the ninety-degree handle metal inserts 58 are tapered on one end. This tapered portion when pressed into the holes in the short cross tubes 44 will make a firm fit. The rubber covering 60 that is encased on metal inserts 58 that are fitted on the static harness line 32 is not shown in this view.

Figure 7:
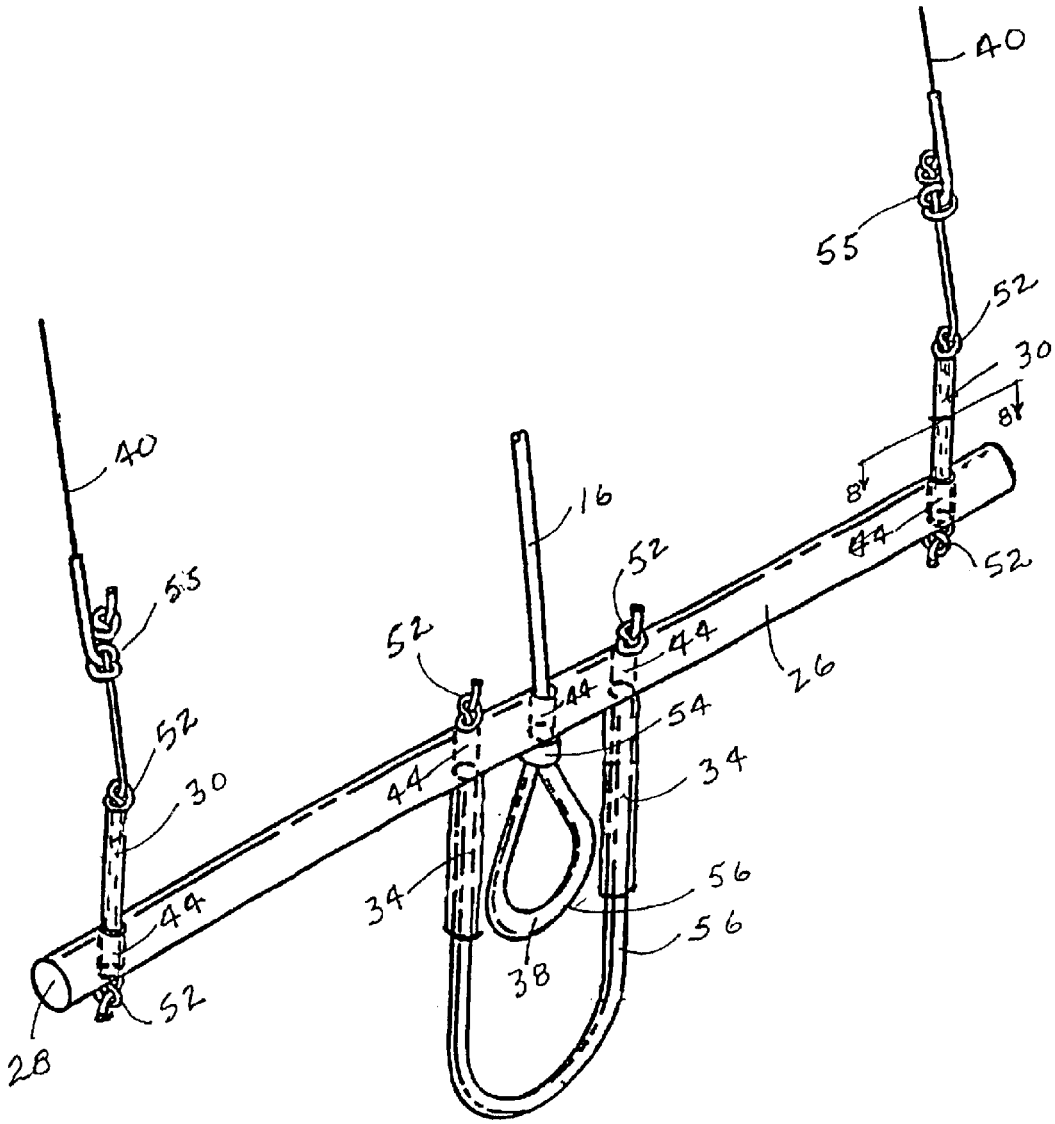
FIG. 7 shows the elements of the kite bar assembly in place.

FIG. 7 shows a complete kite control system with ninety-degree handles 30 covered on the end of kite control bar 26 and ninety-degree handles 34 fitted on the static harness line and loop 32. The ninety-degree handles 34 fitted on the static harness line and loop 32 will provide another means of maneuvering the kite control system. It is noted that control lines 40 have a connector 55 prior to entering the ninety-degree handle tubes 58 (not shown). This allows the control lines 40 to be disconnected from the kite control bar 26 to facilitate storage.

Figure 8:
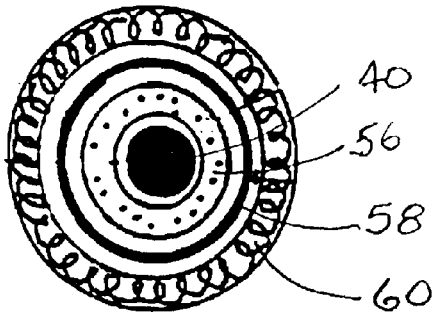
FIG. 8 is a cross section of a finished ninety-degree handle showing the elements of the ninety-degree handle.

FIG. 8 provides a cross section of the ninety-degree handles 30 and the covering that provides comfort for the gripping of the ninety-degree handles 30 with the hands. It is noted that 40 is the control line, 56 is the protective plastic tubing, 58 is the metal tubing forming the ninety-degree handles and 60 is foam rubber cushion material to make the grip softer for the hands.

Figure 9:
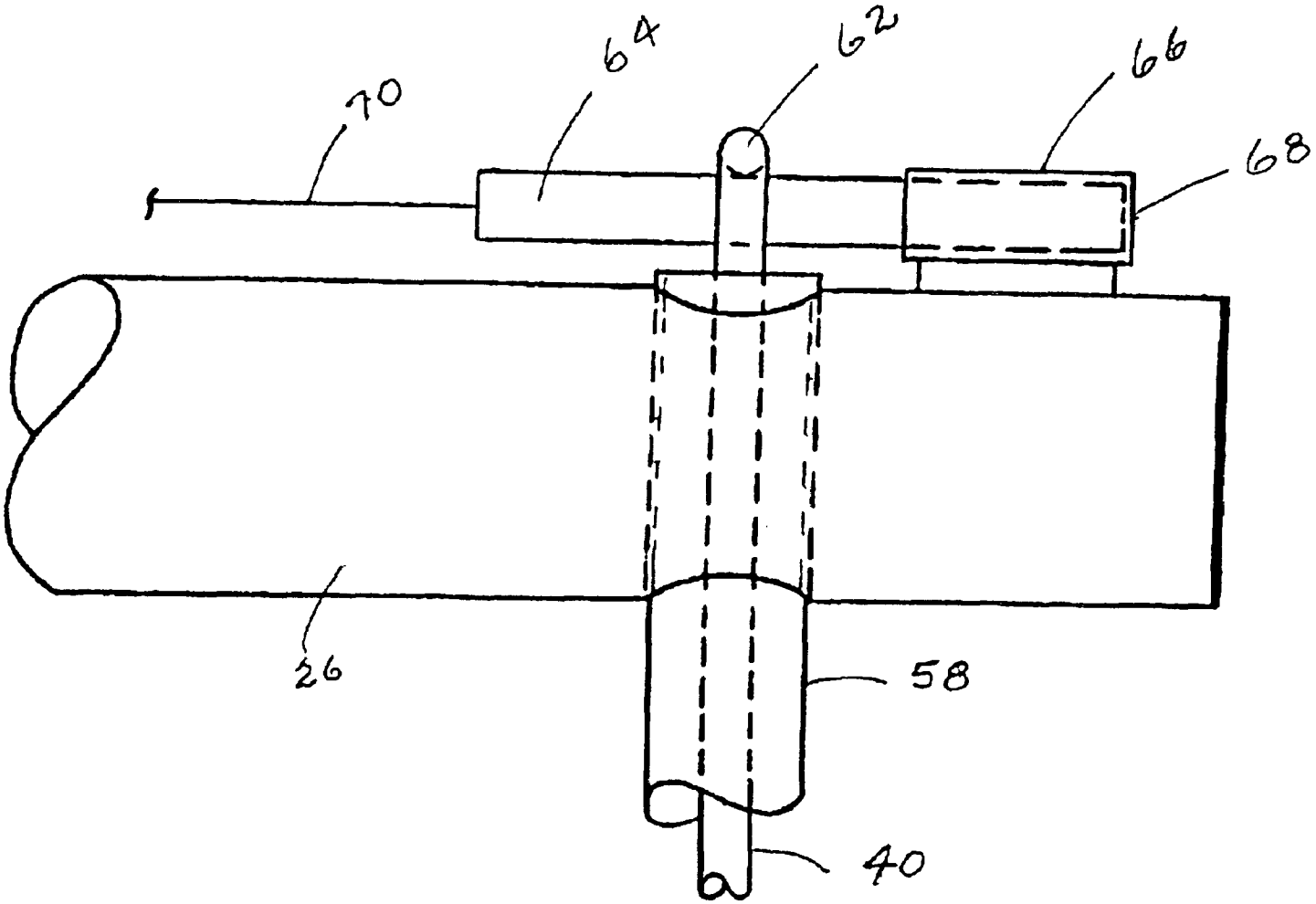
FIG. 9 shows the fail-safe release system attached to one end of the kite control bar that will release the control lines.

FIG. 9 shows an isolated view of the fail-safe release mechanism on one end of the kite control bar 26. In this view there is seen the cross tube 44 welded in the kite control bar 26 and the ninety-degree handle metal inserts 58. The control line 40 in lieu of a knot as shown in FIG. 7 has a loop on the end of the control line given as 62. The control line loop 62 has a metal pin 64 that is captured in a metal tube 66 welded on the kite control bar 26. The metal pin 64 is fitted into the metal tube 66 such that it is a close fit that requires a steady pull on the multi-strand wire 70 to release pin 64. It is noted that the metal tube 66 has an end cap 68 to prevent the pin 64 from going through the tube 66.

Figure 10:
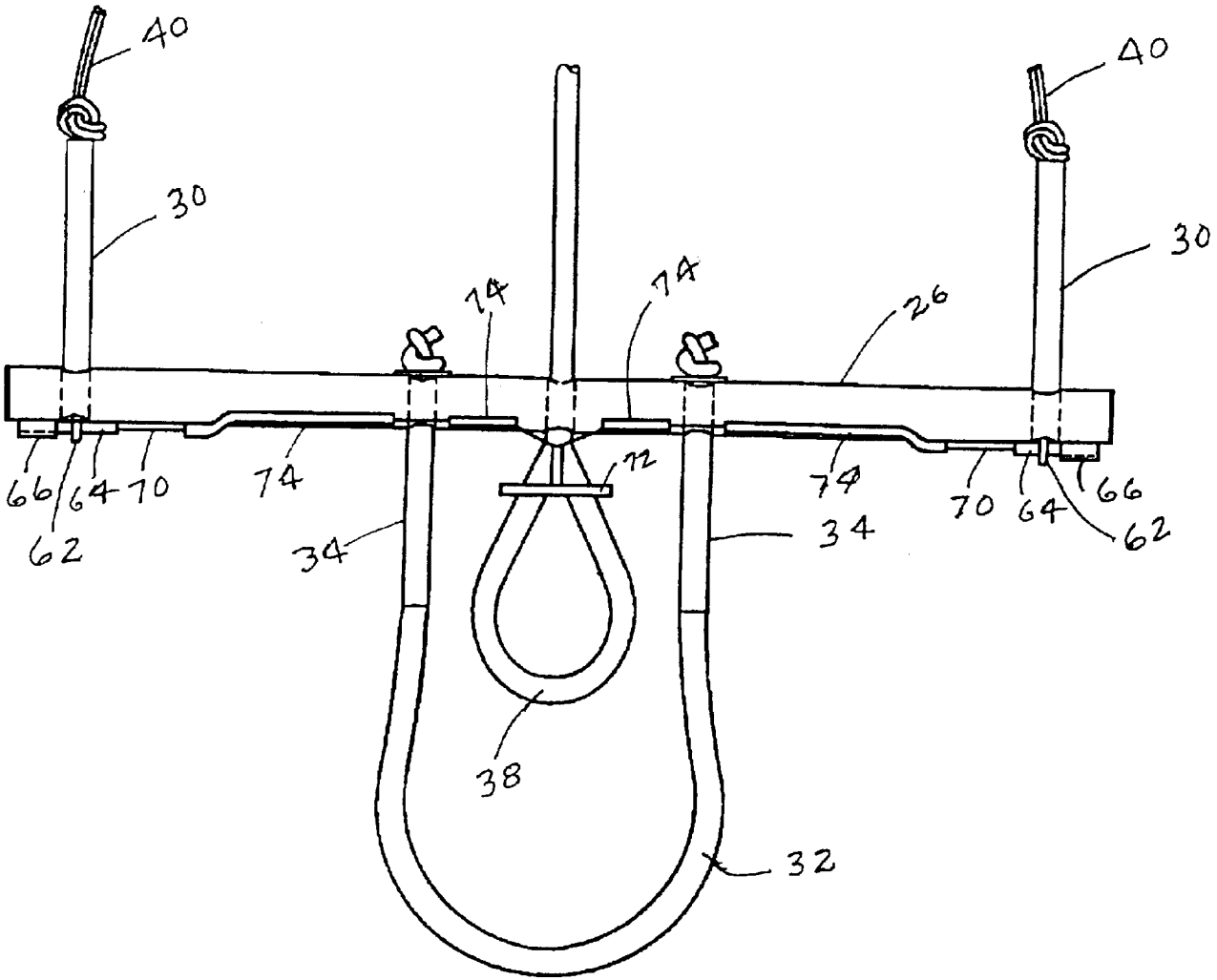
FIG. 10 shows the fail-safe release system attached to both ends of the kite control bar with the release line threaded along the kite control bar.

FIG. 10 shows the preferred embodiment having the ninety-degree handles 30, the dynamic brake line and loop 38 and the static harness line and loop 32. In addition, this view shows guide tubes 74. Guide tubes 74 are welded to kite control bar 26 to guide the multi-strand wire 70 to pin 64. Also seen in this view is handle 72 that is connected to the multi-strand wire 70. The handle 72 when pulled by the kite boarder or kite surfer will release the control lines 40 by pulling pin 64 out of loops 62 and the de-power the kite 20.

Figure 11:
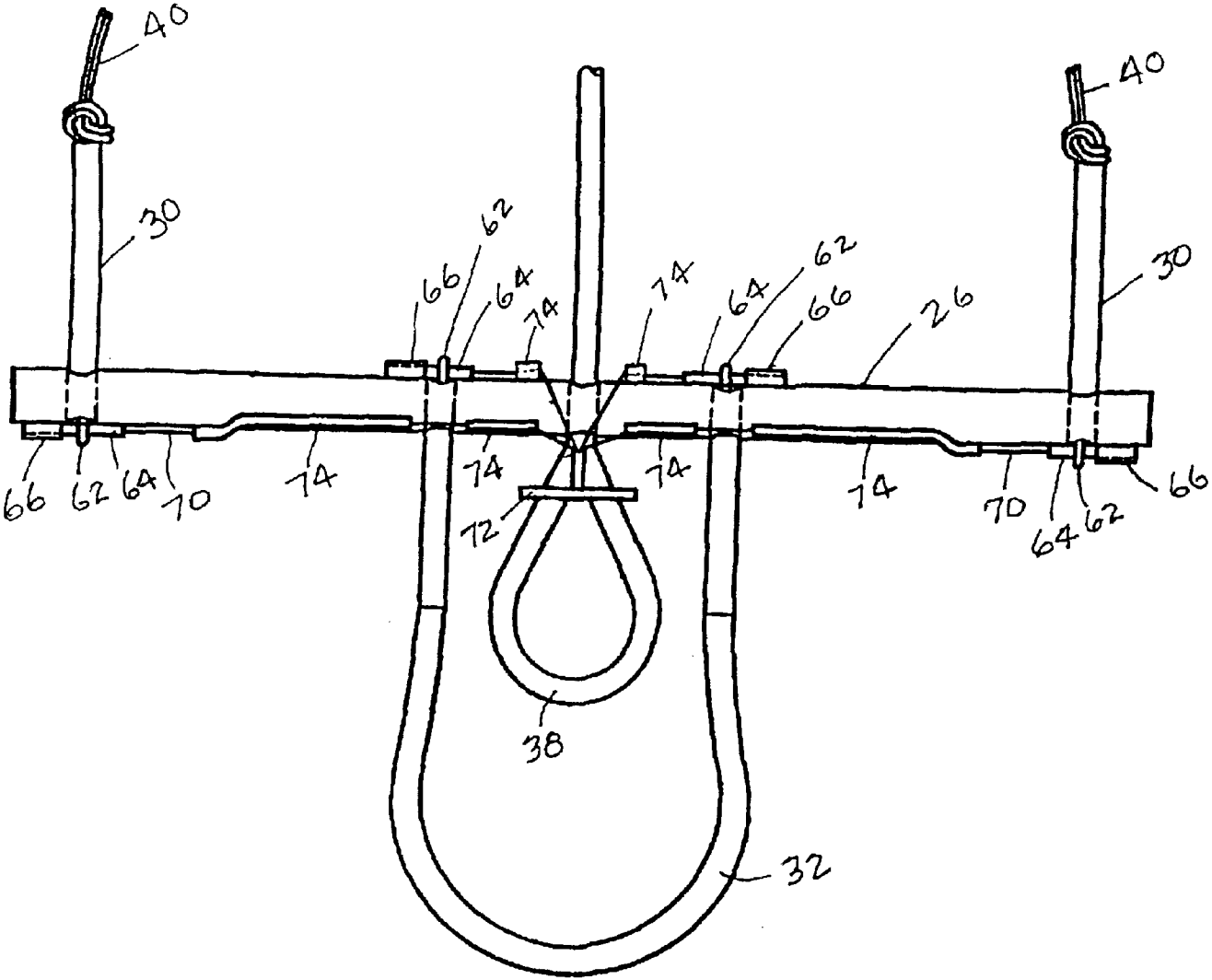
FIG. 11 shows the fail-safe release system attached to both ends of the kite control bar and also shows the release mechanism that will simultaneously release the static harness line loop.

FIG. 11 shows a different embodiment for a release mechanism if it is desired to release the control lines 40 and the static harness line and loop 32 simultaneously. A metal pin 64 is fitted into a metal tube 66 that is welded to the kite control bar 26. The guide tubes 74 are welded to kite control bar 26 whereby the guide tubes 74 have a multi-strand wire 70 running therethrough. A metal pin 64 is fitted into the metal tube 66 such that it is a close fit that requires a steady pull on the multi-strand wire 70 to release pin 64. When both the control lines 40 and static harness line and loop 32 is released by pulling pins 64 out of loops 62 and if the kite boarder or kite surfer is hooked into the static harness line and loop 32, the kite control bar 26 will be free of the kite boarder or kite surfer and they may hold on to the kite control bar 26 with the hands or let the kite control bar 26 go with the de-powered kite. This configuration shown in FIG. 11 may provide more safety if desired by some kite boarders or kite surfers.

Thus, it is apparent that there has been provided in accordance with the invention, a kite control system and a fail-safe release system that fully satisfies the objectives, aims, and advantages set forth above. While the invention has been described in conjunction with specific embodiment thereof, it is evident that many alternatives, modifications, and variations will be apparent to those skilled in the art in light of the aforegoing description. Accordingly, it is intended to embrace all such alternatives modifications, and variations that fall within the spirit and the scope of the appended claims.

What is claimed is:

1. A Kite Control System having a framed airfoil kite with a flexible airfoil shaped envelope, said airfoil kite having a leading edge and a trailing edge and two side edges, said leading edge having an initial opening for inflating the airfoil shaped enveloped where said edge is presented to a flowing air stream;

two control lines attached to the trailing edge of framed airfoil kite;

two dynamic brake lines attached to the leading edge of said framed airfoil kite, said two brake lines being merged into one dynamic brake line;

adjustment means on said dynamic brake lines to increase or decrease the length of said brake line;

a kite control bar having two control lines attached, said kite control bar having said brake line attached, said kite control bar having two static harness lines attached, said kite control bar being a hollow metal bar having 90 degree cross pipes fitted and welded to said kite control bar, said cross pipes being fitted and welded all in the same direction, said kite control bar having the cross pipes fitted and welded equidistant from the end of said kite control bar and two additional cross pipes fitted and welded equidistant from the center of said kite control bar and one cross pipe fitted and welded directly in the center of said kite control bar.

2. A kite control bar as described in claim 1 wherein said two cross pipes fitted and welded equidistant from each end contain hollow removable metal tubes, said hollow removable metal tubes being flared on one end, said hollow removable metal tubes being fitted at 90 degrees to the longitudinal axis of said kite control bar, said hollow removable metal tubes being fitted such that control lines pass through the hollow center portion of said hollow removable tubes.

3. A kite control bar as described in claim 2 wherein said control lines passing through said hollow removable metal tubes are secured by securing means after passing through said hollow removable metal tubes.

4. A kite control bar as described in claim 3 wherein secured means of said control lines is a metal washer having a knot tied thereon after said control lines pass through said washer.

5. A kite control bar as described in claim 3 wherein said securing means of said control lines is a metal pin, said metal pin passing through a loop in an end of said control lines.

6. A kite control bar as described in claim 1 wherein said dynamic brake line passes through said cross pipe fitted and welded directly in the center of said kite control bar, said dynamic brake line forming a loop after passing through said cross pipes, said loop formed by the end of said dynamic brake line being fitted into a stop, said stop prevents said dynamic brake line from passing through said cross pipe fitted and welded in said control bar.

7. A kite control bar as described in claim 1 wherein said two cross pipes welded and fitted toward the center of said kite control bar, said cross pipes each containing a hollow removable metal tube, said hollow removable metal tube being flared at one end, said hollow removable metal tube force fitted into said cross pipe welded and fitted equidistant from the center of said kite control bar, said hollow removable metal tubes containing static harness lines forming a loop after passing through said hollow removable metal tubes, said static harness lines being secured by securing means.

8. A kite control bar as described in claim 7 wherein said securing means of said static harness lines is a metal washer having a knot tied thereon after said harness lines passing through said washer.

9. A kite control bar as described in claim 7 wherein said securing means of said static lines and said control lines is a metal pin, said metal pin passing through a loop in an end of said static harness lines and said control lines.

10. A kite control bar as described in claim 1 wherein said kite control bar has attached thereto a release mechanism to release said control lines and de-power said kite, wherein said release mechanism is a pin, said pin being attached to a flexible cable, said flexible cable having a handle attached thereto, said handle when pulled removes said pin from said loop in an end of said control lines and releases said control lines from said kite control bar which in turn will de-power said kite.

11. A kite control bar as described in claim 1 wherein said kite control bar has attached thereto a release mechanism to simultaneously release said static harness lines and said control lines.

12. A kite control bar as described in claim 1 wherein said release mechanism is a pin, said pin being attached to a flexible cable, said flexible cable having a handle attached thereto, said handle when pulled will simultaneously release said static harness lines and said control lines and de-power said kite.

* * * * *